US010370884B2

(12) United States Patent
Stuke

(10) Patent No.: US 10,370,884 B2
(45) Date of Patent: Aug. 6, 2019

(54) HINGE

(71) Applicant: HETTICH-ONI GMBH & CO. KG, Vlotho (DE)

(72) Inventor: Kai Michael Stuke, Bielefeld (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 260 days.

(21) Appl. No.: 15/311,585

(22) PCT Filed: May 13, 2015

(86) PCT No.: PCT/EP2015/060689
§ 371 (c)(1),
(2) Date: Nov. 16, 2016

(87) PCT Pub. No.: WO2015/173353
PCT Pub. Date: Nov. 19, 2015

(65) Prior Publication Data

US 2017/0138106 A1 May 18, 2017

(30) Foreign Application Priority Data

May 16, 2014 (DE) ..... 10 2014 106 910

(51) Int. Cl.
*E05F 1/10* (2006.01)
*E05D 11/10* (2006.01)
(Continued)

(52) U.S. Cl.
CPC ..... *E05F 1/1008* (2013.01); *E05D 11/1021* (2013.01); *E05F 1/14* (2013.01);
(Continued)

(58) Field of Classification Search
CPC ..... Y10T 16/5383; Y10T 16/2771; Y10T 16/304; Y10T 16/299; Y10T 16/61;
(Continued)

(56) References Cited

U.S. PATENT DOCUMENTS 7,861,376 B2 * 1/2011 Fitz ..... E05D 3/16 16/286
8,424,161 B2 * 4/2013 Sutterlutti ..... E05F 5/006 16/286
(Continued)

FOREIGN PATENT DOCUMENTS

DE 202006003196 U1 8/2007
DE 202012012211 3/2014
(Continued)

OTHER PUBLICATIONS

International Search Report of PCT/EP2015/060689 dated Aug. 19, 2015.
(Continued)

*Primary Examiner* — William L Miller
(74) *Attorney, Agent, or Firm* — Barnes & Thornburg LLP

(57) ABSTRACT

A hinge comprises a hinge part, which can be secured on a door of the shutter and is mounted on a side part such that it can be pivoted via a carrying lever and a guide lever, also comprises at least one spring, by means of which the hinge part, in a self-retracting region of the hinge, is prestressed into a closed position, and further comprises a linear damper with a piston rod, which can be moved relative to a damper housing and is intended for damping a closing and/or opening movement of the hinge part, wherein a deflecting element is provided, said deflecting element being mounted on the side part such that it can be rotated about an axis and being arranged between the damper and the guide lever so that, during a closing movement of the hinge part, it moves the damper in order to generate a damping force, wherein, during an opening movement of the hinge part, the deflecting element moves the damper in order to generate a damping force before the fully open position of the hinge
(Continued)

part has been reached. This makes it possible to avoid hard impact of a door in the opening direction.

12 Claims, 9 Drawing Sheets

(51) Int. Cl.
*E05F 1/14* (2006.01)
*E05F 5/00* (2017.01)

(52) U.S. Cl.
CPC ..... *E05F 5/006* (2013.01); *E05Y 2800/73* (2013.01); *E05Y 2900/20* (2013.01); *Y10T 16/5383* (2015.01)

(58) Field of Classification Search
CPC ..... Y10T 16/625; E05F 1/1008; E05F 1/14; E05F 3/20; E05F 5/006; E05F 5/02; E05D 11/1021; E05D 3/16; E05Y 2800/73; E05Y 2900/20
USPC ..... 16/286, 54, 50, 65, 82, 85; 312/319.2
See application file for complete search history.

(56) References Cited

U.S. PATENT DOCUMENTS

2005/0155180 A1 7/2005 Lin
2011/0019946 A1* 1/2011 Krammer ..... E05F 5/006 384/20
2011/0298349 A1* 12/2011 Sutterlutti ..... E05F 5/006 312/326
2013/0145580 A1* 6/2013 Brunnmayr ..... E05F 5/006 16/277
2013/0160242 A1* 6/2013 Brunnmayr ..... E05F 5/006 16/286
2014/0331451 A1* 11/2014 Holzapfel ..... E05F 5/006 16/286
2015/0361709 A1* 12/2015 Stuke ..... E05D 3/16 16/352
2017/0101814 A1* 4/2017 Buschmann ..... E05F 5/006
2017/0138106 A1* 5/2017 Stuke ..... E05D 11/1021
2017/0241175 A1* 8/2017 Hammerer ..... E05D 3/16
2018/0087307 A1* 3/2018 Hammerer ..... E05D 3/06
2018/0100339 A1* 4/2018 Kirenci ..... E05F 5/006
2018/0155974 A1* 6/2018 Kirenci ..... E05F 5/006
2018/0209193 A1* 7/2018 Hammerer ..... E05F 3/20

FOREIGN PATENT DOCUMENTS

EP 1555372 7/2005
EP 2093361 8/2009
EP 2176486 4/2010

OTHER PUBLICATIONS

English translation of International Search Report of PCT/EP2015/060689 dated Aug. 19, 2015.
Search Report issued in German Application No. 102014106910.2 dated Jul. 28, 2014.

* cited by examiner

HINGE

CROSS REFERENCE TO RELATED APPLICATIONS

This application is a U.S. nationalization under 35 U.S.C. § 371 of International Application No. PCT/EP2015/060689, filed May 13, 2015, which claims priority to German Application No. 102014106910.2 filed May 16, 2014.

BACKGROUND AND SUMMARY OF THE DISCLOSURE

The present disclosure relates to a hinge having a hinge part, which is fixable on a door or flap of an item of furniture or domestic appliance in particular, and which is mounted so it is pivotable on a side part via a support lever and a guide lever, at least one spring, by means of which the hinge part is pre-tensioned in a closed position in a self-retraction range of the hinge, and a linear damper having a piston rod, which is movable in relation to a damper housing, for damping a closing and opening movement of the hinge part, wherein a deflection element is provided, which is mounted so it is rotatable about an axis on the side part and is arranged between the damper and the guide lever, to move the damper to generate a damping force during a closing movement of the hinge part.

EP 2 176 486 discloses a hinge, in which a hinge part is mounted so it is pivotable on a side part, in which a linear damper is arranged. During a closing movement of the hinge part, the linear damper, which is designed as a compression damper, is compressed and decelerates the closing movement to avoid slamming of the door. Such a hinge has proven itself in practice and is advantageously installed in various items of furniture. However, during an opening movement of the door, deceleration on stopping can produce substantial material strain.

The present disclosure illustrates and describes a hinge which may provide for improved handling.

According to the disclosure, the hinge has a deflection element arranged between the guide lever and the linear damper, which moves the damper to generate a damping force during a closing movement of the hinge part and additionally moves the damper to generate a damping force during an opening movement of the hinge part before reaching the maximally open position. The linear damper is actuated via the deflection element so that a damping force is generated during a closing movement of the hinge part before reaching the closed position and also a damping force is generated during an opening movement of the hinge part shortly before reaching the maximally open position. The linear damper can be used both for closing damping and also opening dampening. During an opening movement of the hinge, slamming is therefore avoided upon reaching the maximally open position, because the opening movement is decelerated by the linear damper shortly before the open position. This reduces the material strain during a rapid opening movement, because an abrupt deceleration in the maximally open position is avoided.

According to one preferred embodiment of the invention, the opening damping is active at least in an angle range of at least 10°, for example, at least 20°, before the maximally open position of the hinge part. The beginning of the opening damping can be selected depending on the maximally open position of the hinge part, which can be arranged, for example, at 90°, 100°, or 110°. At least damping over an angle range of greater than 20° can ensure sufficient deceleration in the opening direction by the linear damper.

The direction of the relative movement between piston rod and damper housing during a closing procedure of the hinge in the closing damping range of the hinge may be the same as the direction as during the opening procedure of the hinge in the opening damping range. The relative movement is to be understood as a movement between the piston and the damper housing, independently of which of the two bodies is actually moved. It is also possible that both bodies move simultaneously. If a compression damper is used, which generates a damping force during the retraction of the piston rod into the damper housing, the piston rod may therefore be retracted into the damper housing both during the closing damping and also during the opening damping. Vice versa, if a traction damper is used, the piston rod is extended out of the damper housing in the damping range in each case, both during the opening damping and also during the closing damping.

The deflection element, which is mounted on an axis, preferably executes a pendulum movement during a movement from the completely closed position of the hinge part to the completely open position of the hinge part. A pendulum movement in this case means a movement which firstly includes a rotational movement in one direction and then a rotational movement in the opposite direction. The movement direction of the pendulum movement of the deflection element reverses in this case from a movement from a completely closed position of the hinge part into the completely open position of the hinge part between the closing damping range and the opening damping range. This enables the use of a single linear damper to provide both opening damping and also closing damping.

The stroke of the linear damping during closing damping may be greater than the stroke of the linear damper during opening damping. With equal rotational velocity of the hinge part in relation to the side part, the damping forces during closing are therefore greater than during opening. Usually, the door is slightly decelerated in any case during opening, so that lower damping forces can be selected, which are perceived to be less annoying by the user, when he moves the door against the damping forces.

The damper may be designed as a compression damper, in which higher damping forces are generated during the retraction of the piston rod into the damper housing than during the extension of the piston rod out of the damper housing. A particularly compact construction can thus be obtained, because compression dampers in shorter construction can be used.

In another embodiment, the damper may be designed as a traction damper, in which higher damping forces are generated during the extension of the piston rod out of the damper housing than during the retraction of the piston rod into the damper housing.

The spring which pre-tensions the hinge in the closed position in a self-retraction range of the hinge may also be designed as an opening hinge, which moves the hinge part into the completely open position from an opening angle of the hinge. In another embodiment, this function can also be assumed by at least one separate opening spring, so that a closing spring and an opening spring are provided.

DETAILED DESCRIPTION OF THE DRAWINGS

Figure 1:
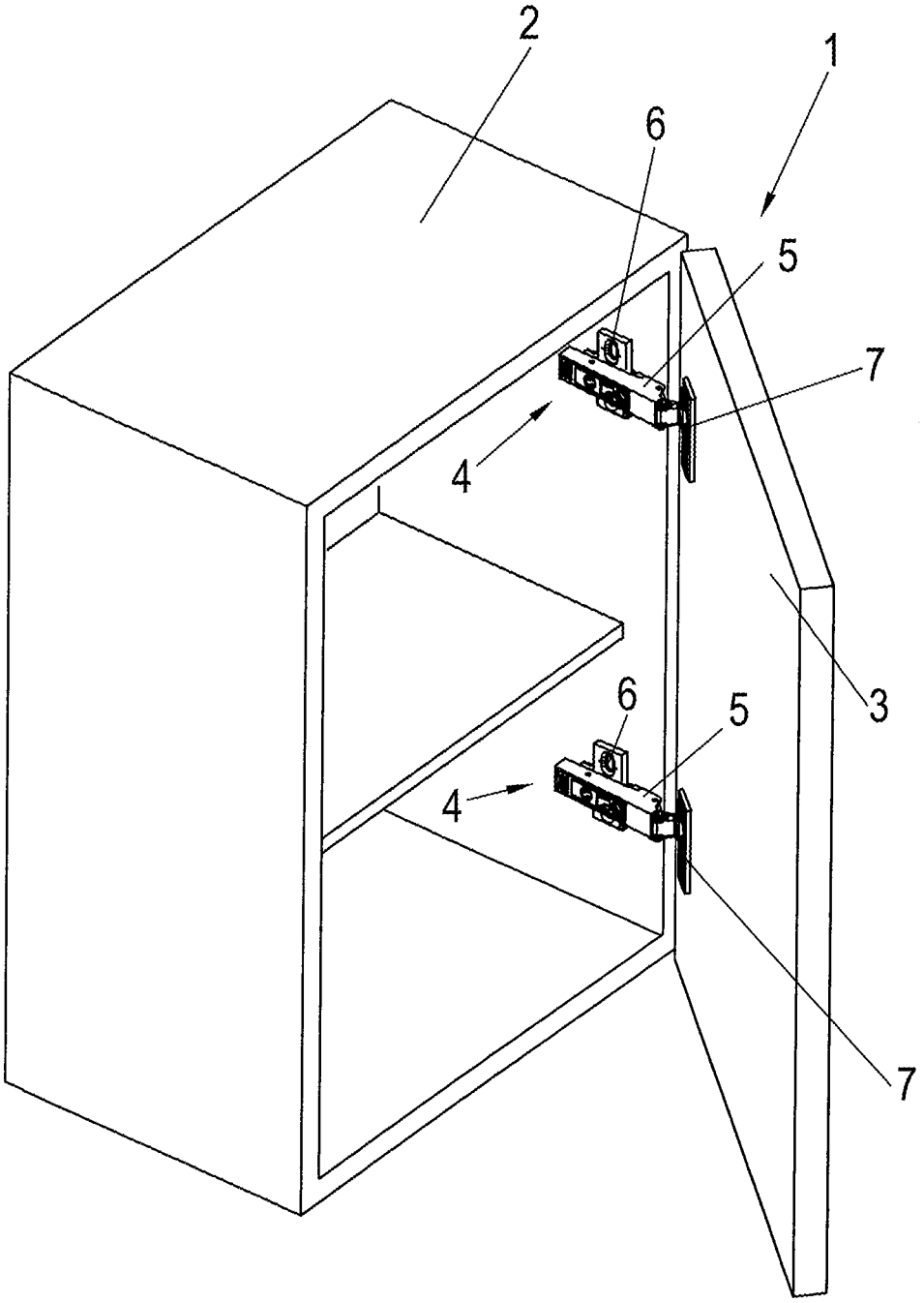
FIG. 1 shows a perspective view of an item of furniture having two hinges according to the present disclosure.

An item of furniture 1 comprises a cabinet-shaped furniture body 2, on the side wall of which two hinges 4 are provided for the pivotable mounting of a door 3. Each hinge 4 comprises an installation plate 6 in this case, which is fixed on a side wall of the furniture body 2, wherein a side part 5 of the hinge 4 is held on the installation plate 6. A hinge part 7 is mounted so it is pivotable via a four-joint connection on the side part 5.

Figure 2:
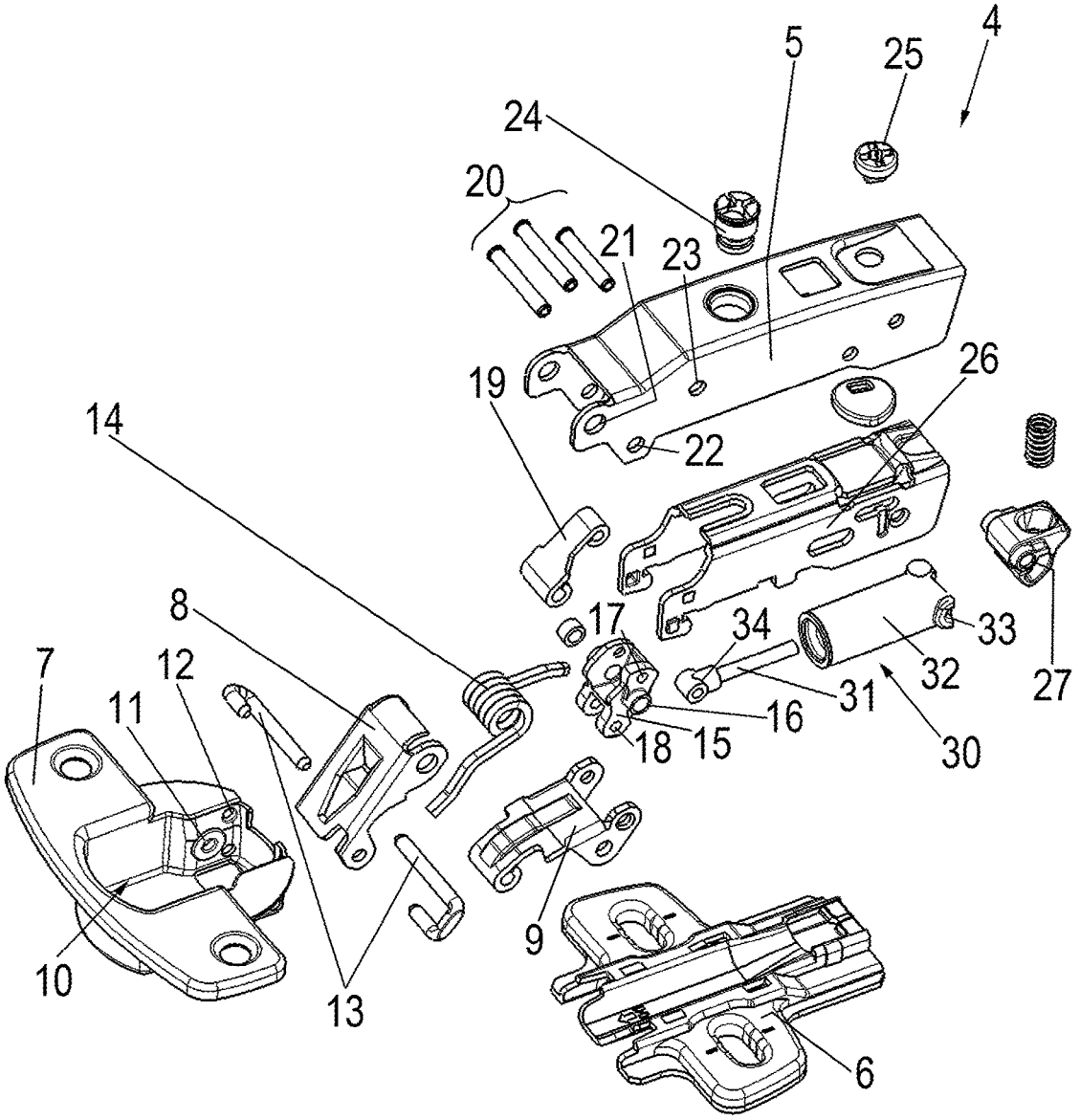
FIG. 2 shows a perspective exploded illustration of a hinge according to the present disclosure.

FIG. 2 shows the hinge 4 in detail. The hinge 4 comprises the installation plate 6, which is fixable on the furniture body, and on which an inner part 26 is fixed, which is in turn used for the fixation of the side part 5. The side part 5 is movable via a first adjustment element 24 and a second adjustment element 25 in relation to the installation plate 6 and the inner part 26, to be able to align the position of the door 3 in relation to the furniture body 2.

The side part 5 is designed as box-shaped and comprises openings 21, 22, and 23, which are used for mounting axes 20, on opposing side walls.

The hinge part 7 comprises a cup-shaped receptacle 10, wherein openings 11 and 12 for axis elements 13 are formed on side walls of the cup-shaped receptacle 10. The axis elements 13 are designed as U-shaped and have a longer leg, which is used as the axis of rotation for a support lever 8 or a guide lever 9. The support lever 8 is mounted on the hinge part 7 in this case so it is rotatable about the axis inserted into the opening 11 and the guide part 9 is mounted on the hinge part 7 so it is rotatable about the axis inserted into the opening 12.

A spring 14, which has two protruding legs and is designed as a retraction spring, is also arranged between the support lever 8 and the guide lever 9. The hinge part 7 is pre-tensioned in the closed position in a self-retraction range of the hinge 4 via the spring 14.

The support lever 8 is mounted so it is rotatable on the side part 5 via an axis 20, which is inserted into the opening 21, while the guide lever 9 is mounted so it is rotatable on the side part 5 about an axis 20, which is inserted into the opening 22. Spaced apart from the axes at the openings 21 and 22, an axis 16 is inserted into the opening 23 to mount a deflection element 15 so it is rotatable about an axis 16. The deflection element 15 is designed as a two-armed lever, wherein an axis 17 for the articulation with a lever 19 is provided on a first lever arm. This lever is articulated on one side with the deflection element 15 and on the other side with a cantilever on the guide lever 9. The deflection element 15 has a second arm, on which an axis 18 is provided, to articulate the deflection element 15 with a damper 30, which is designed as a linear damper. The damper 30 comprises a piston rod 31 and a damper housing 32, in which a piston is arranged. By retracting and extending the piston rod 31, the piston is moved within the damper housing 32, wherein damping forces are generated during the retraction of the piston rod 31, while the extension of the piston rod 31 occurs comparatively smoothly. The damper is therefore designed as a compression damper, which essentially only generates damping forces during the retraction of the piston rod 31. The piston rod 31 is provided in this case on the outer end with a connecting element 34, which is articulated with the second arm with the axis 18 of the deflection element 15. On the opposite side, the damper housing 32 is equipped with a holder 33, to articulate the damper 30 in the side part 5.

To fix the side part 5 on the installation plate, a pivotable catch device 27 is furthermore also provided.

Figure 3:
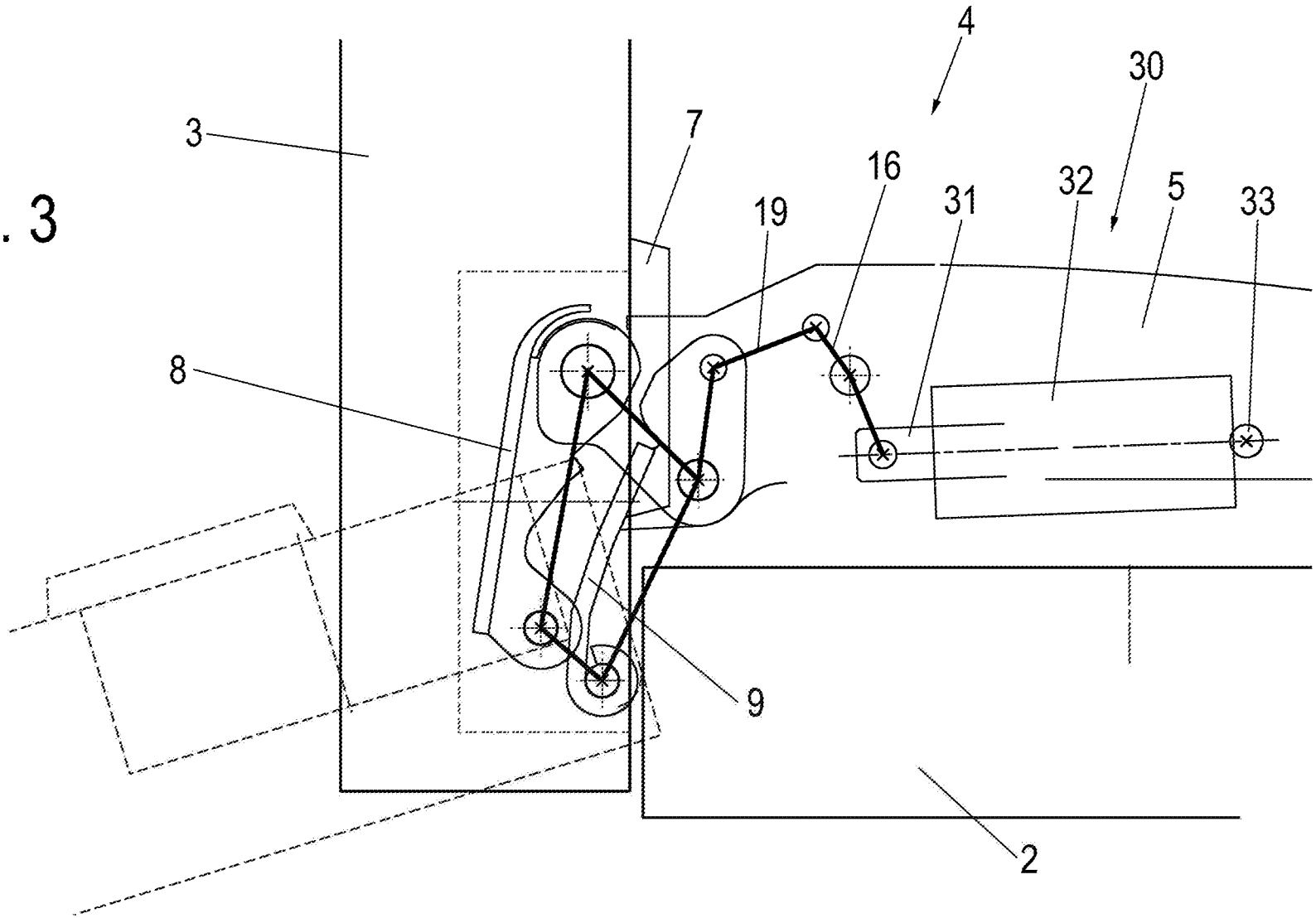
FIGS. 3 to 7 show multiple detail views of the hinge of FIG. 2 during the opening and closing procedures.

FIG. 3 shows the hinge 4 in a closed position, in which the door 3 is held in a closed position. The hinge 4 is only schematically shown in this case, because essentially the position of the hinge part 7 and the movement of the damper 30 connected thereto are important for the explanation of the opening and closing movement. In the closed position, the damper 30 is in the retracted position, in which the piston rod 31 is substantially retracted into the damper housing 32. If the hinge 4 is now opened (FIG. 4), the hinge part 7 pivots in accordance with the four-joint connection via the support lever 8 and the guide lever 9, wherein the schematically shown lever 19 rotates the deflection element 15 clockwise about the axis 16. The piston rod 31 is thus slightly extended out of the damper housing 32, wherein the extension of the piston rod 31 takes place smoothly, so that hardly any braking effect is perceptible during opening. The hinge part can be moved further in the opening direction together with the door 3 corresponding to FIG. 5, wherein the piston rod 31 is extended still further out of the damper housing 32 by the above-described mechanism.

Figure 5:
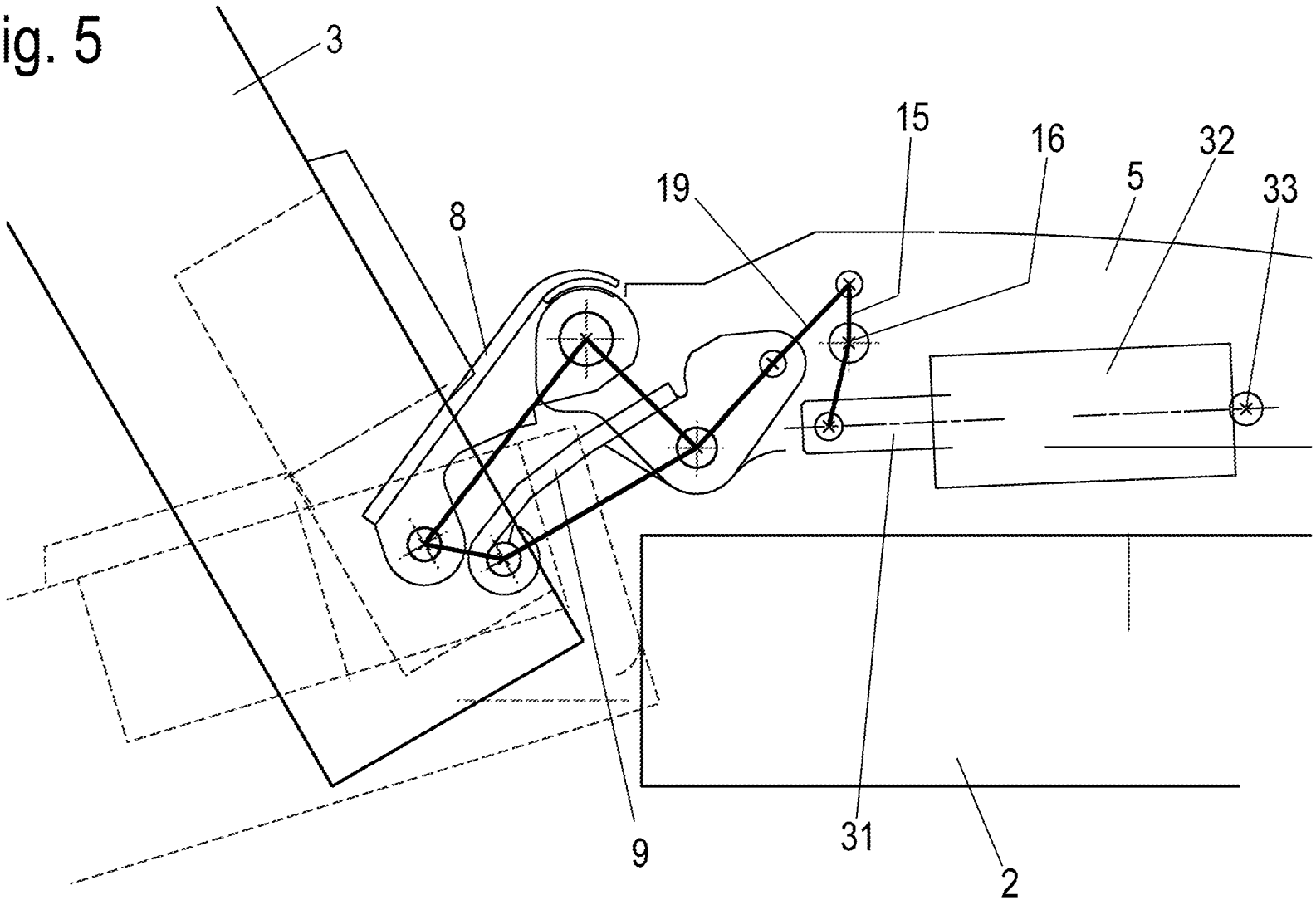
Figure 6:
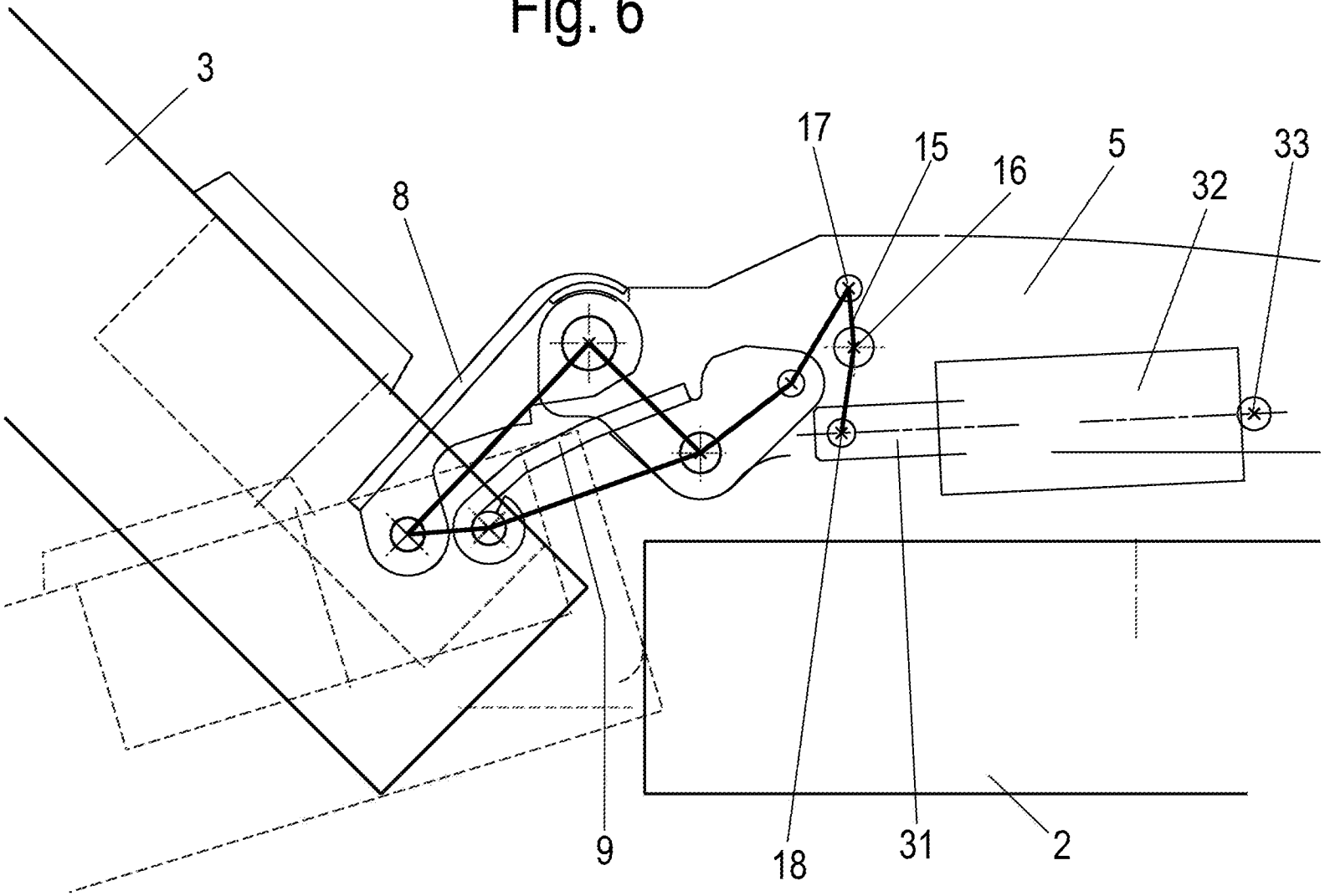

If the door 3 is moved further in the opening direction between the positions shown in FIG. 5 and FIG. 6, the piston rod 31 is hardly moved further in relation to the damper housing 32, so that the opening movement can occur smoothly.

Figure 7:
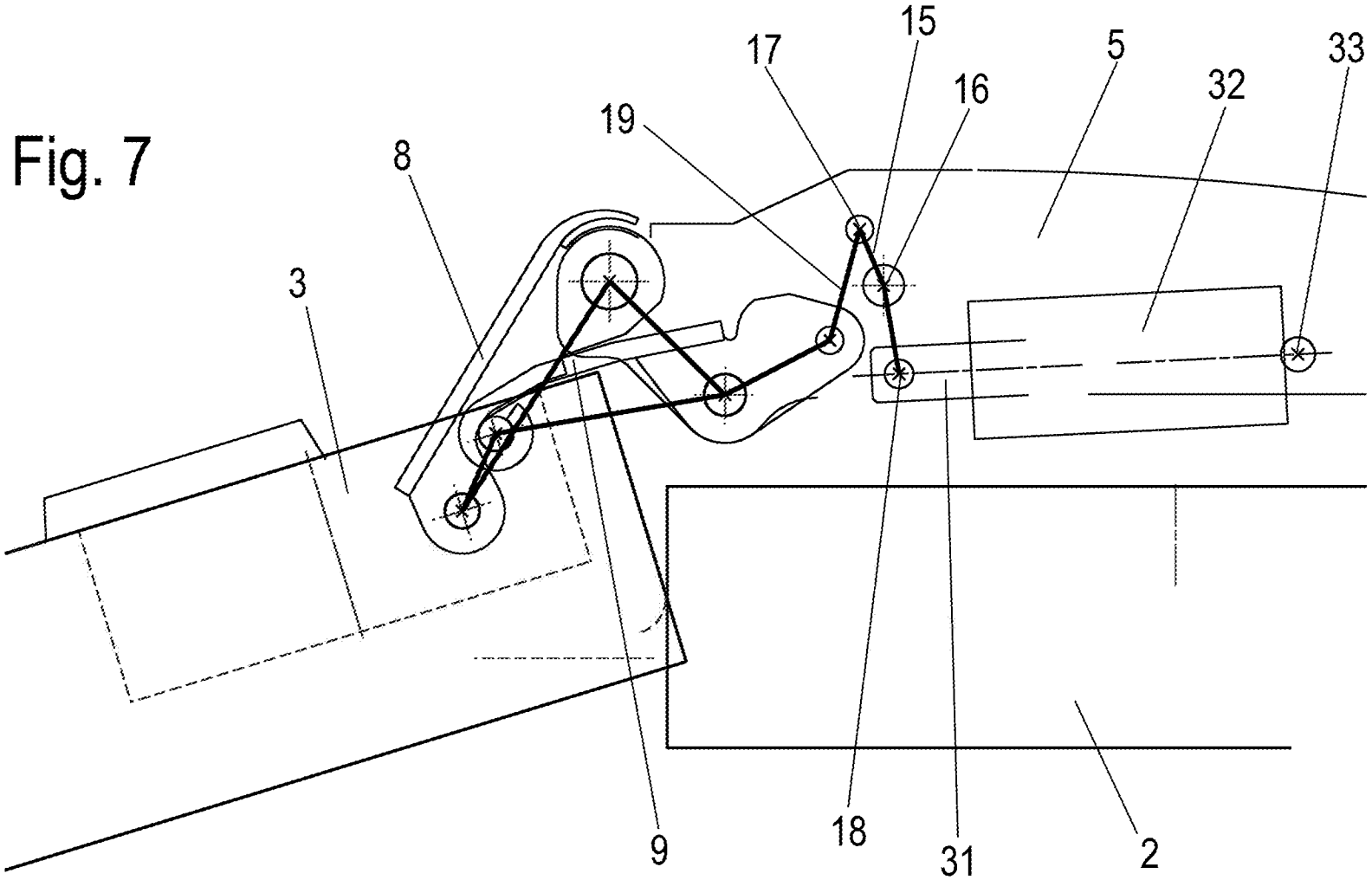

If the door 3 is now pivoted into the maximally open position, as shown in FIG. 7, the pivoting of the support lever 8 and the guide lever 9 causes pivoting of the deflection element 15 counterclockwise, so that the piston rod 31 is retracted back into the damper housing 32. During the retraction of the piston rod 31 into the damper housing 32, damping forces are generated, which ensure a deceleration of the opening movement of the door 3.

Figure 4:
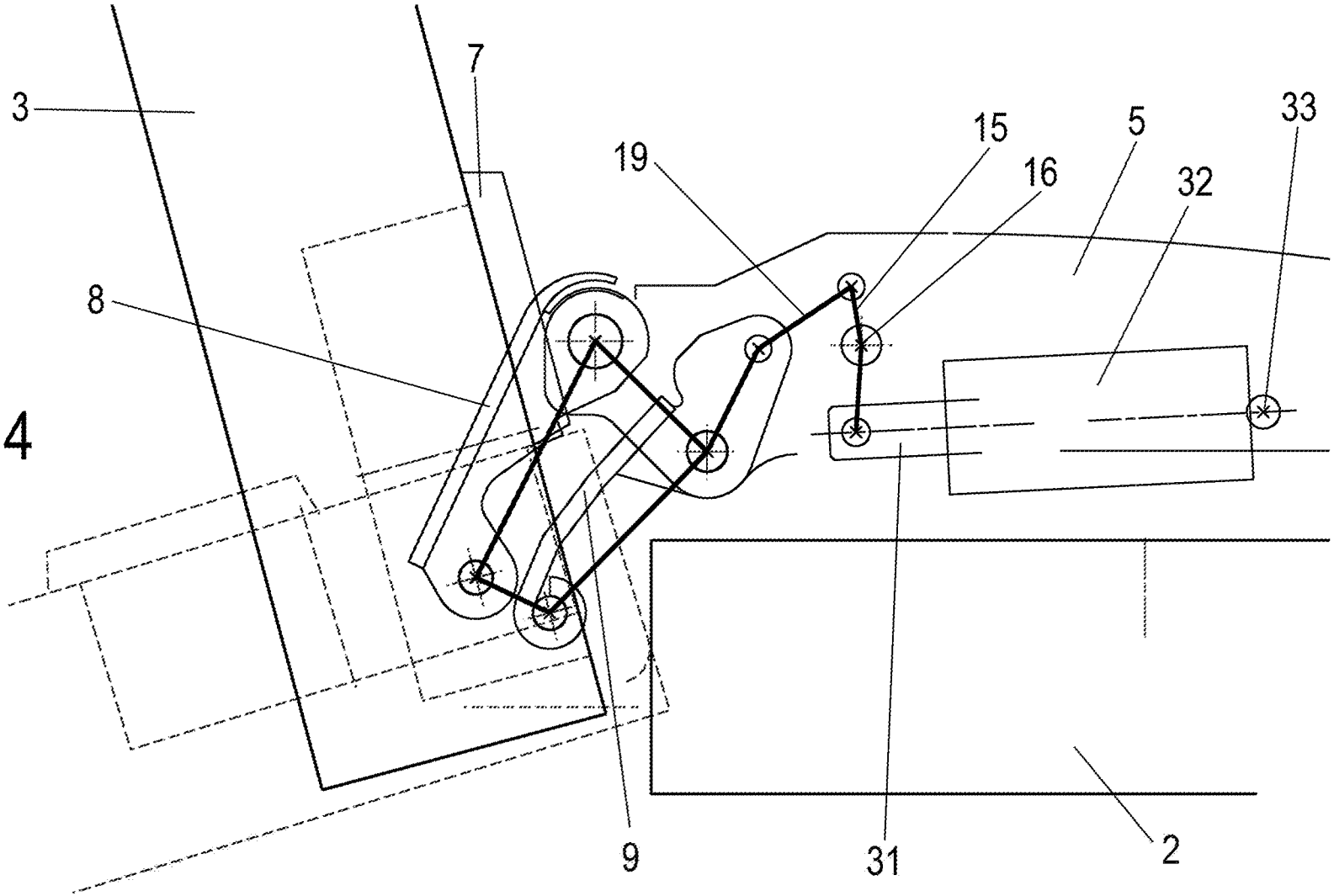

If the door 3 is now moved out of the maximally open position back in the closing direction, the piston rod 31 is firstly extended back out of the damper housing 32, wherein the extension of the piston rod 31 occurs smoothly, so that hardly any forces are perceptible by the user. Subsequently, the positions according to FIGS. 6, 5, 4 are passed through, wherein from a specific angle range, the piston rod 31 is retracted into the damper housing 32 again, as shown in FIGS. 4 and 3. A closing damping thus begins in that the damper 30 generates damping forces before reaching the closed position.

Figure 8:
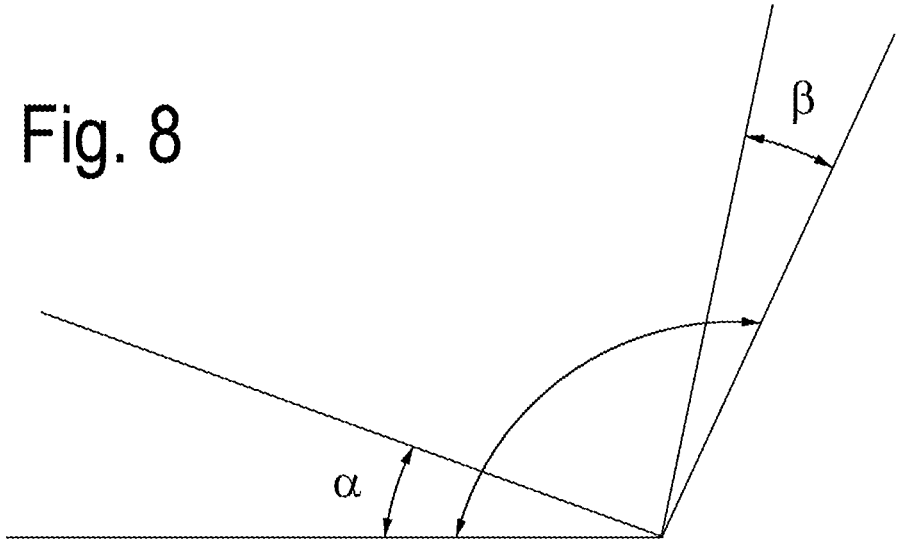
FIG. 8 shows a diagram of the active range of the damper.

FIG. 8 schematically shows the range of the closing damping $\alpha$ and the opening damping $\beta$. During the pivoting of the hinge part 7 in relation to the side part 5, closing damping can be caused via the damper 30 in an angle range $\alpha$ before reaching the closed position, for example, in a range between 0° and 30°. Furthermore, before reaching a maximally open position, opening damping is caused via the damper 30 in an angle range $\beta$. The opening damping can be caused, for example, in a range of at least 10°, in particular at least 20°, before reaching the maximally open position. The maximally open position can be 80° to 120° depending on the hinge type. In a middle range between the closing damping $\alpha$ and the opening damping $\beta$, the damper 30 is essentially inactive, so as not to obstruct opening or closing of the door 3. The middle range, in which the damper 30 is inactive, can be between 45° and 70°, for example.

Figure 9:
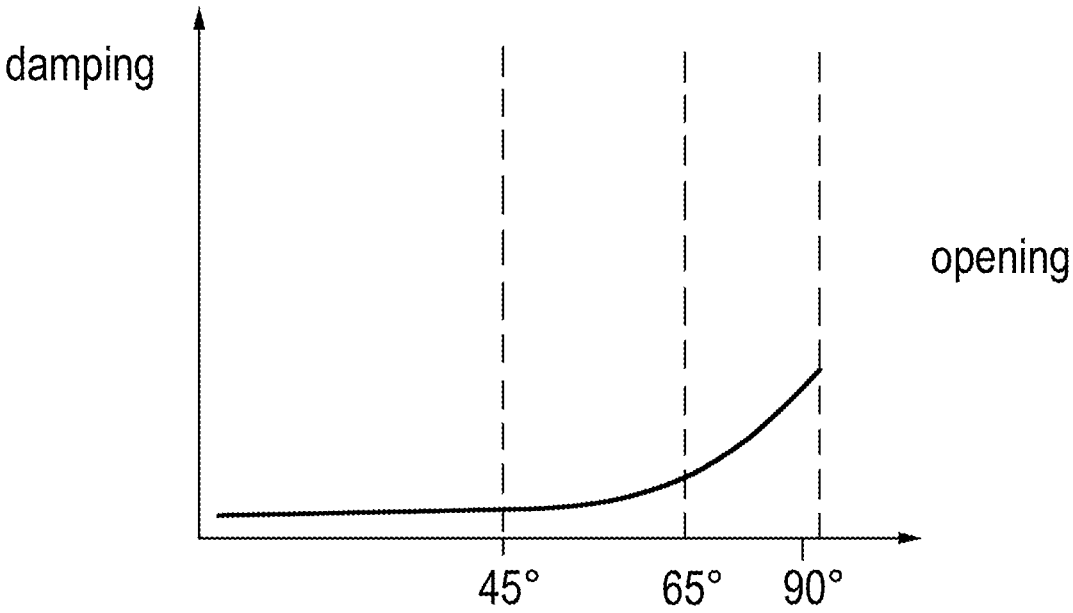
FIG. 9 shows a diagram of the opening damping.

FIG. 9 schematically shows the opening damping. During the opening of the door 3, initially hardly any forces act due to the damper 30, except for negligible friction losses during the extension of the piston rod 31. The damping force first increases at an angle range from approximately 60° to 65°, up to the maximally open position, which was selected at 90° in FIG. 9. The opening damping is therefore essentially active in a range between 65° and 90°.

Figure 10:
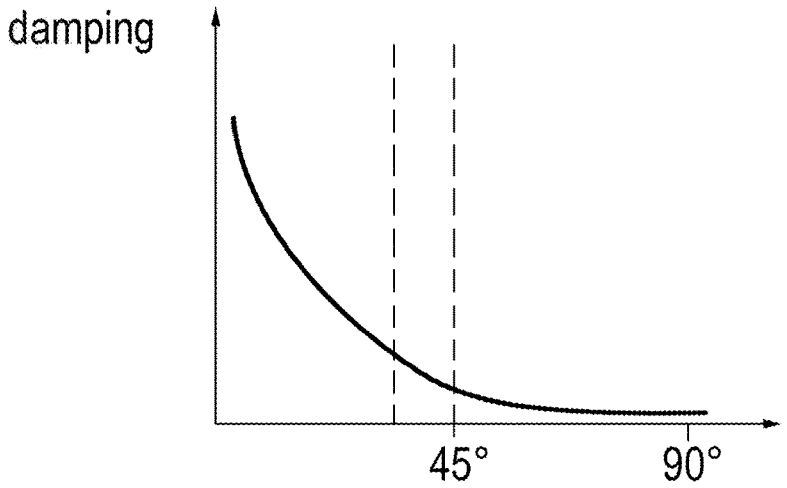
FIG. 10 shows a diagram of the closing damping.

FIG. 10 shows the closing damping in a diagram. During the closing of the door 3, essentially no forces act due to the damper 30, except for negligible friction forces, up to an angle range of 45°. The damper 30 first becomes active before reaching a closed position, for example, in an angle range between 0° and 35°, wherein the damping forces are greatest shortly before reaching the closed position, so that a door 3 is sufficiently decelerated to avoid slamming noises at least shortly before reaching the closed position. With regard to the closing movement, it is also to be noted that the spring 14 moves the door 3 into the closed position in a self-retraction range. The self-retraction range can be in a range between 0° to 40°, for example.

Figure 11:
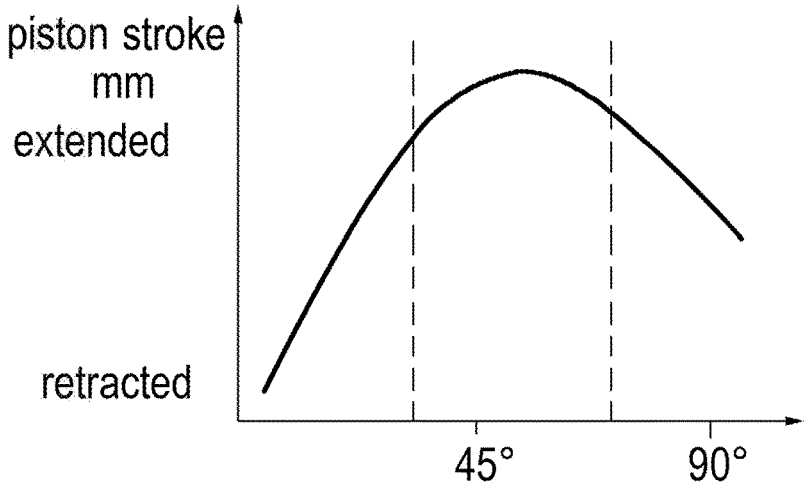
FIG. 11 shows a diagram of a compression damper.

FIG. 11 shows the piston stroke of a damper 30 over the angle range. The damper 30 is designed as a compression damper, so that it has a piston rod 31 retracted into the damper housing 32 in the closed position. The piston rod 31 is then extended out of the closed position during an opening movement, wherein the piston stroke is greater in an initial angle range between 0° and 30° than in a middle range. The piston rod 31 is then retracted back into the housing 32 shortly before reaching the maximally open position, as schematically shown in FIG. 11.

Figure 12:
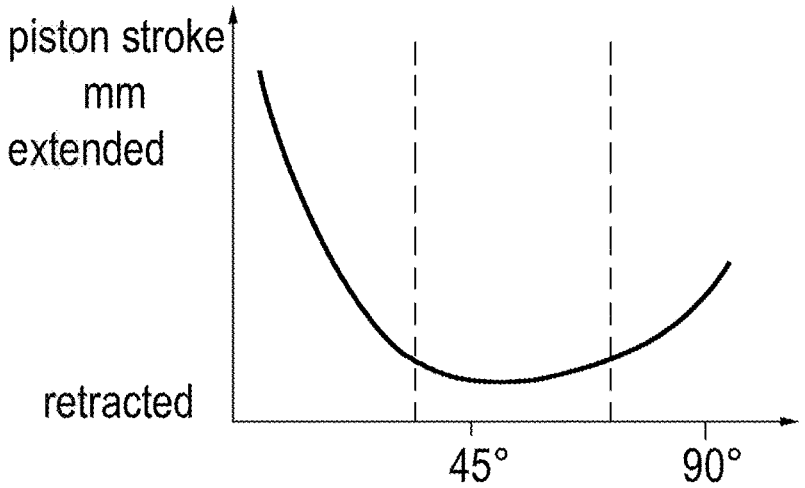
FIG. 12 shows a diagram of a traction damper.

If a traction damper is used instead of a compression damper, a piston stroke results as shown in FIG. 12. In a closed position, the piston rod 31 is then firstly extended out of the damper housing 32 and is retracted during the movement of the hinge 4. The damping forces then arise during the extension of the piston rod out of the damper housing.

In the illustrated exemplary embodiment, the deflection element is indirectly connected to the piston rod 31 of the damper 30. Of course, it is also possible to provide one or more components between the deflection element and the damper, without modifying the mechanical action principle of the hinge. The deflection element 15 is furthermore connected via a lever 19 to the guide lever 9. It is also possible to connect the deflection element 15 directly to the support lever 8 or the guide lever 9 or to arrange still further levers or components in between, without changing the mechanism according to the invention of the hinge 4.

Instead of the damper 30 designed as a compression damper, a traction damper can also be used, by means of which opening and closing damping can also be caused.

The damper 30 can additionally be designed as adjustable, to be able to adapt the damping forces to the weight of the respective door 3. Corresponding mechanisms and adjustment mechanisms are known. In addition, the damper can also have more components than the damper housing and a piston rod, for example, a piston rod can be provided on opposing sides of the damper, which is then retracted into the damper housing or extended out of it.

In a further exemplary embodiment, the spring 14 can pre-tension the hinge part 7 in an opening direction in a self-opening range, wherein preferably the same spring 14 pre-tensions the hinge part 7 in a closed position in the self-retraction range of the hinge 4. A door or flap can be held in a predetermined open position by the pre-tensioning in the open direction. The pre-tensioning in the opening direction can take place, for example, from an opening angle of 45°, in particular greater than 60° or 70° up to the maximally open position.

The invention claimed is:

1. A hinge comprising:

a hinge part pivotably mounted to a side part by a guide lever and a support lever;

at least one spring configured to pretension the hinge part in a closed position with respect to the side part in a self-retraction range of the hinge;

a linear damper having a damper housing and a piston rod movable in relation to the damper housing;

a deflection element rotatably mounted about an axis on the side part; and a lever pivotably connected to the guide lever and to the deflection element;

wherein the guide lever, the support lever, and the lever cooperate to rotate the deflection element in a first direction in response to rotation of the hinge part in a closing direction, thereby moving the piston in a first direction with respect to the damper housing to generate a damping movement during a closing movement of the hinge part; and wherein the guide lever, the support lever, and the lever cooperate to rotate the deflection element in the first direction in response to rotation of the hinge part in an opening direction, thereby moving the piston in the first direction with respect to the damper housing to generate a damping movement during an opening movement of the hinge part.

2. The hinge according to claim 1, wherein the opening damping is active at least in an angle range of at least 10° before the maximally open position of the hinge part.

3. The hinge according to claim 1, wherein the deflection element executes a pendulum movement during a movement from the completely closed position of the hinge part into the completely open position of the hinge part.

4. The hinge according to claim 3, wherein the movement direction of the pendulum movement of the deflection element during a movement from the completely closed position of the hinge part into the completely open position of the hinge part reverses between the closing damping range and the opening damping range.

5. The hinge according to claim 1, wherein the movement of the piston rod of the damper during the closing damping is greater than the movement of the piston rod of the damper during the opening movement.

6. The hinge according to claim 1, wherein the stroke of the damper during closing damping is greater than the stroke of the damper during opening damping.

7. The hinge according to claim 1, wherein the rotatably mounted deflection element is articulated with the damper or a component coupled to the damper.

8. The hinge according to claim 1, wherein the deflection element is articulated with the guide lever or a component connected to the guide lever.

9. The hinge according to claim 1, wherein the damper is a compression damper, which generates higher damping forces during the relative retraction of the piston rod into the damper housing than during the extension of the piston rod out of the damper housing.

10. The hinge according to claim 1, wherein the damper is a traction damper, which generates higher damping forces during the relative extension of the piston rod-out of the damper housing than during the retraction of the piston rod into the damper housing.

11. The hinge according to claim 1, wherein the at least one spring pre-tensions the hinge part in an opening direction in a self-opening range, wherein the at least one spring pre-tensions the hinge part in a closed position in the self-retraction range of the hinge.

12. The hinge according to claim 1, wherein the opening damping is active at least in an angle range of at least 20° before the maximally open position of the hinge part.

* * * * *